US006921247B2

(12) United States Patent
Stewart et al.

(10) Patent No.: US 6,921,247 B2
(45) Date of Patent: Jul. 26, 2005

(54) SNAP-TOGETHER MODULAR FAN TRAY ASSEMBLY FOR AN ELECTRONICS ENCLOSURE

(75) Inventors: Thomas E. Stewart, Saratoga, CA (US); Robert J. Lajara, San Jose, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 122 days.

(21) Appl. No.: 10/413,281

(22) Filed: Apr. 14, 2003

(65) Prior Publication Data

US 2004/0202541 A1 Oct. 14, 2004

(51) Int. Cl.[7] ..... F01D 25/26

(52) U.S. Cl. ..... 415/213.1; 415/214.1; 417/423.14; 417/423.15

(58) Field of Search ..... 415/213.1, 214.1; 417/423.14, 423.15, 423.5; 361/687, 694, 695, 696, 697, 724, 725, 727

(56) References Cited

U.S. PATENT DOCUMENTS

| | | | | |
|---|---|---|---|---|
| 4,834,615 | A | 5/1989 | Mauch et al. | |
| 4,926,291 | A | 5/1990 | Sarraf | |
| 5,788,566 | A | 8/1998 | McAnally et al. | |
| 5,852,547 | A | 12/1998 | Kitlas et al. | |
| 5,926,370 | A | 7/1999 | Cromwell | |
| 5,940,288 | A | 8/1999 | Kociecki | |
| 5,955,955 | A | 9/1999 | Corcoran, Jr. et al. | |
| 6,071,082 | A | 6/2000 | Lecinski et al. | |
| 6,086,476 | A | 7/2000 | Paquin et al. | |
| 6,186,889 | B1 | 2/2001 | Byrne | |
| 6,213,819 | B1 | 4/2001 | Fan | |
| 6,236,564 | B1 | 5/2001 | Fan | |
| 6,252,770 | B1 * | 6/2001 | Yu et al. | 361/695 |
| 6,285,548 | B1 | 9/2001 | Hamlet et al. | |
| 6,388,880 | B1 | 5/2002 | El-Ghobashy et al. | |
| 6,549,406 | B1 * | 4/2003 | Olesiewicz et al. | 361/695 |
| 6,708,372 | B2 * | 3/2004 | Stewart | 16/422 |
| 6,783,325 | B1 | 8/2004 | Hileman et al. | |

* cited by examiner

*Primary Examiner*—Hoang Nguyen
(74) *Attorney, Agent, or Firm*—Meyertons Hood Kivlin Kowert & Goetzel, P.C.; B. Noël Kivlin

(57) ABSTRACT

A fan tray assembly for an electronics enclosure includes two opposing, spaced apart shells made of a sheet material. The opposing shells are attached to each other by attachment features formed in the sheet material of each shell. Advantageously, the attachment features reduce or eliminate the need for separate fasteners, spring steels, or adhesives to attach the shells. Each shell has openings and grills. Each shell also has retention features formed in the sheet material around a periphery of their respective grills. A ventilation fan unit (e.g., two fans) is retained between the two shells by the retention features. An electrical connector is connected to the ventilation fan and retained by at least one of the shells. The shells may also include features for retaining the electrical connector without using fasteners or adhesives. Such features may allow the connector to float in a plane perpendicular to its principal axis of alignment. The assembly may additionally include a handle for detaching the assembly to the electronic enclosure.

29 Claims, 8 Drawing Sheets

SNAP-TOGETHER MODULAR FAN TRAY ASSEMBLY FOR AN ELECTRONICS ENCLOSURE

BACKGROUND OF THE INVENTION

1. Field of the Invention

The present invention relates to snap-together modular ventilation fan assemblies for electronics enclosures.

2. Description of Related Art

Modular ventilation fan assemblies, sometimes called fan tray assemblies (or more briefly, "fan trays") are used for mounting ventilation fans to electronics enclosures, such as computer enclosures. Conductive enclosures are used to contain electromagnetic interference (EMI) generated by electronic equipment, and ventilation fans are often used for thermal control of their enclosed interior spaces. The fan tray provides for convenient mounting of one or more ventilation fans to the electronics enclosure while maintaining the EMI-shielding integrity of the enclosure. The fan tray may also provide a convenient location for mounting a control circuit for the ventilation fan or fans in the fan tray.

The ventilation fan itself is usually a modular unit that includes a rotor and a motor encased in a plastic housing. As such, it does not provide EMI shielding and may itself be a source of EMI. Fan trays therefore typically provide metal grills on opposite sides of the fan to electromagnetically isolate the ventilation fan from the environment outside of the fan tray, while allowing for the passage of air through the fan tray. At the same time, the metal grills and sheet metal walls of the fan tray maintain electromagnetic isolation for the interior of the electronics enclosure and serve as part of the wall thereof.

Fan trays are often mounted to the electronics enclosures using a pair of opposing side rails that engage corresponding rails in the electronics enclosure. The fan tray may be mounted to, and removed from, the enclosure by sliding the tray along these rails. The fan tray may be secured to the enclosure using a screw or like fastener after being slid into place along the rails. As modular assemblies, prior art fan trays facilitate assembly and repair of electronics enclosures, particularly when a fan control circuit is included in the fan tray.

However, prior art fan trays are subject to various shortcomings. They are typically assembled from sheet metal components and fastened together using screws or like fasteners. Screws are also used to fasten assembled fan trays to electronics enclosures. The use of screws or like fasteners increases assembly and removal time, and increases the number of tray components. The use of these prior art fasteners can also damage the fans and/or take the fan trays out of industry standards. For example, if too much pressure is applied at the fan edges, the fans can be damaged. By contrast, if too little pressure is applied at the fan edges, the fans in the fan trays produce a high amount of acoustical noise that can take the fan trays out of industry standards (e.g., standards on restricting the amount of noise produced). All of these factors can add substantially to the cost of fan trays, as well as create inconveniences for users.

It is therefore desirable to provide a fan tray assembly that overcomes these and other shortcomings of prior art fan tray assemblies, while retaining their advantages. More specifically, it is desirable to provide a fan tray assembly that has features in which airflow is not impeded, acoustical noise is reduced, assembly and disassembly is simplified, and cost of manufacturing is reduced.

SUMMARY OF THE INVENTION

The present invention provides a fan tray assembly that requires no removable fasteners, spring steels (e.g., not standard sheet steels), or other loose hardware in its assembly. The fan tray assembly can be used with prior art electronics enclosures while requiring minimal or no modifications to the enclosure. It can be assembled from inexpensive sheet metal pieces (shells) without the need of removable fasteners or spring steels, for decreased assembly cost. For this purpose, the shells can include attachment features for attaching the shells to one another, and retention features for retaining one or more ventilation fans between the shells. The attachment and retention features (or coupling elements) can be formed integrally with the shells from the same sheet of material (and/or having no spring steel). Taken together, the attachment and retention features reduce or eliminate the need to use loose hardware, spring steels, or adhesive for fastening during assembly.

Advantageously, the fan tray assembly may also comprise a pivoting grab handle to assist with removal of the fan tray assembly from the enclosure. The pivoting grab handle may be advantageously attached to the fan tray assembly without any fasteners. The fan tray may also provides for attachment of a fan control circuit on a printed circuit board (PCB) without the use of any fasteners.

Other beneficial features of the fan tray assembly include improved air grills and/or air holes that substantially improve air flow through the fan tray. A more complete understanding of the fan tray assembly will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides a fan tray assembly that overcomes the limitations of prior art fan trays. In the detailed description that follows, like element numerals are used to indicate like elements that appear in one or more of the drawings.

Figure 1:
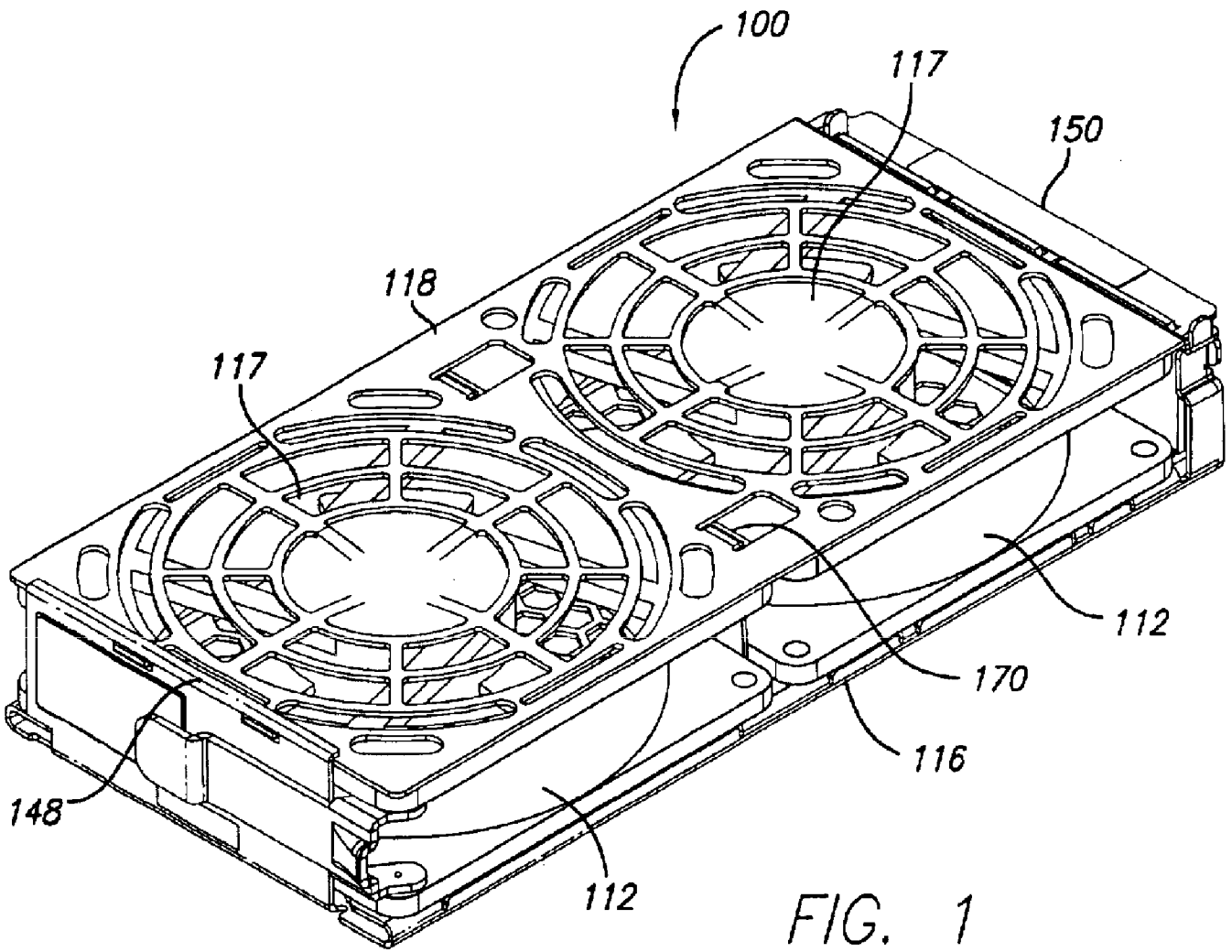
FIG. 1 is a perspective view of an exemplary fan tray assembly.
Figure 2:
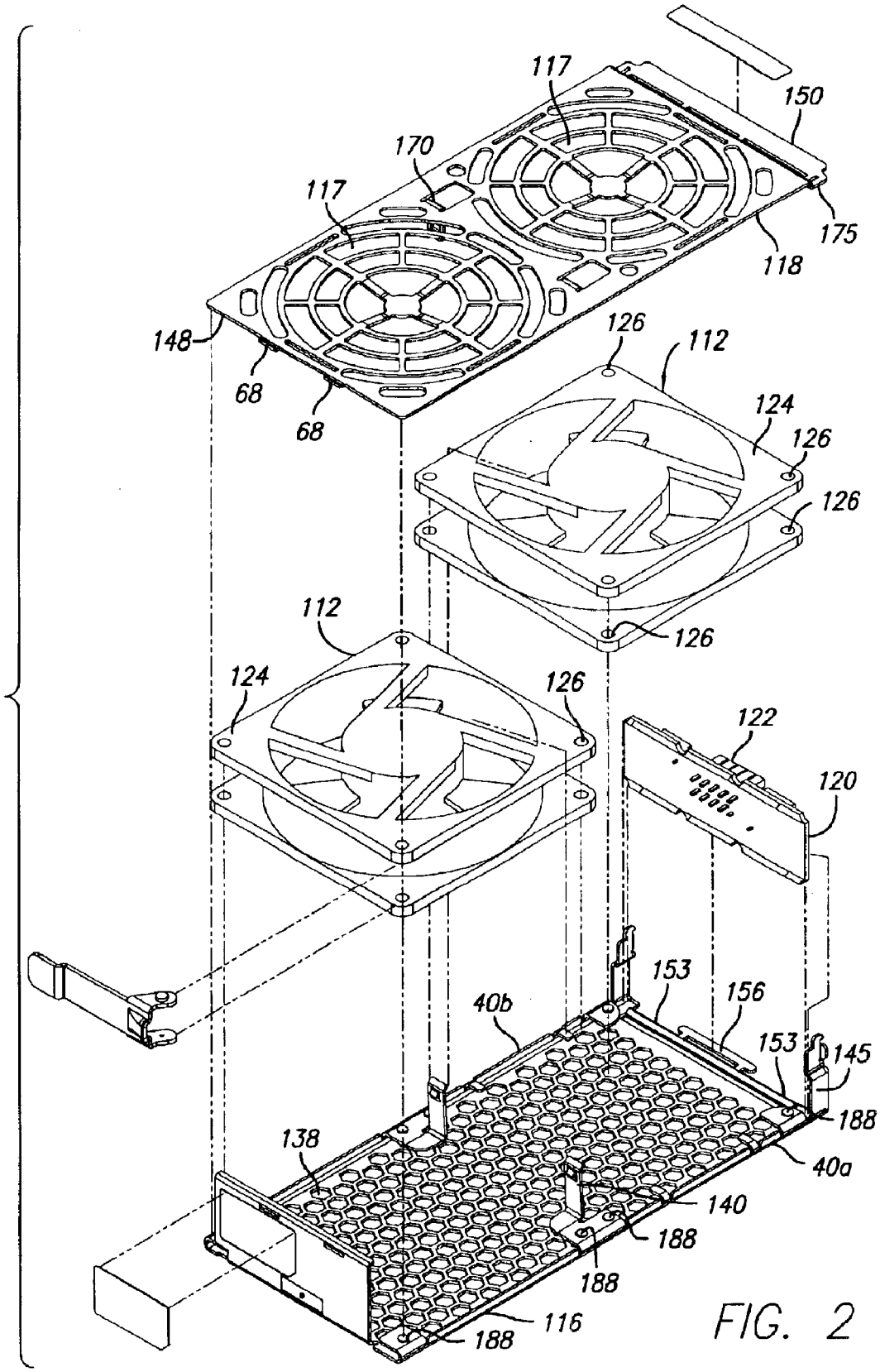
FIG. 2 is an exploded assembly view of the exemplary fan tray assembly shown in FIG. 1.

Referring to FIGS. 1 and 2, exemplary fan tray 100 comprises two opposing shells 116, 118, sometimes called brackets. The shells 116, 118 are attached to one another using a plurality of interlocking attachment features, such as top center snap element 170 and tab slot 174 and corresponding bottom center snap element 140 and snap tab 182, shown in FIG. 3 or bottom corner snap element 145 and hook 185 and corresponding top hook eyelet 175 shown in FIGS. 4 and 5. Each shell is made of a suitable sheet material, such as sheet steel or other conductive and structural material, which may be suitably surface treated or coated as known in the art. All of the features of the shells may be formed in the same sheet of material, such as by a suitable stamping and bending operation, thereby eliminating unnecessary assembly operations. In one embodiment, the shells are formed using only standard sheet material (e.g., using only standard sheet steels without spring steels).

Each of shells 116, 118 has a plurality of grills and/or openings 117, 138 forming an inlet and an outlet for passage of air through the shells, of which two grills 117 in the top shell 118 are shown in FIGS. 1 and 2 and a plurality of octagonal openings 138 in the bottom shell 116 are shown in FIG. 2. In one embodiment of the present invention, the plurality of octagonal openings 138 do not have to be substantially aligned with the grills 117 in the opposing shell, for efficient air flow through the fan tray.

Figure 5:
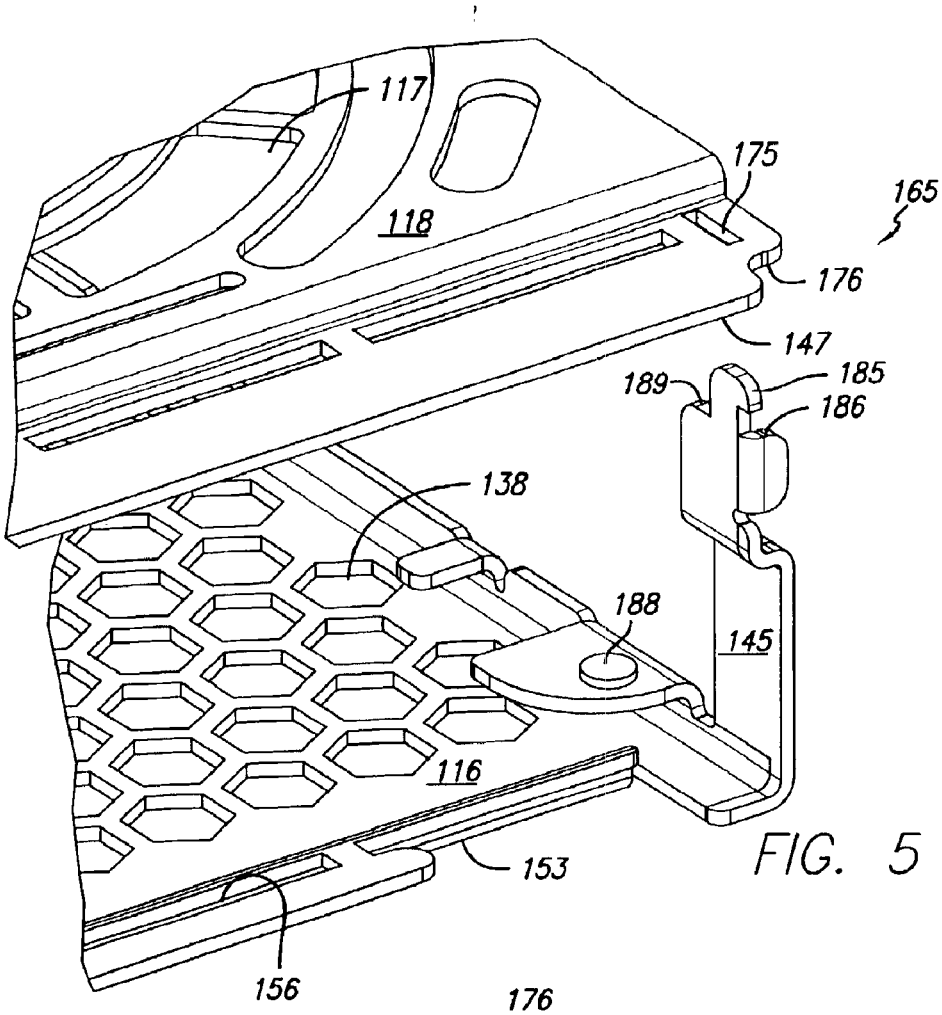
FIG. 5 is another exploded assembly view of the exemplary coupling feature shown in FIG. 4.
Figure 12:
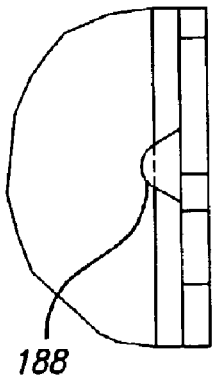
FIG. 12 a detail view of a retention dimple on the shells of the exemplary fan tray assembly shown in FIGS. 1 and 2.

Ventilation fans 112 are retained between the two shells by retention features, such as dimples 188 shown in FIGS. 2, 5, and 12. The retention features are described in more detail below. Each of the ventilation fans 112, as known in the art, can comprise a rotor (not shown) encased in a frame 124. Frame 124 may include one or more features for engagement with retention features (such as dimples 188) of the shells. For example, the fan frame 124 may include a plurality of through holes 126. Such holes are commonly used in prior art assemblies for holding threaded fasteners used for attaching the fan to an assembly. Utilization of these holes in a new and different way in the present assembly advantageously allows the fan tray assembly to make use of commonly available prior art ventilation fans. Each of the ventilation fans 112 also include a cable connector (not shown) for connecting the fan to a power source.

Assembly 100 additionally includes an electrical connector 122 for transmitting power to the ventilation fan. Connector 122 may also be used to transmit signals and power to a control circuit in the fan tray assembly. It may be connected to the ventilation fan using cable connector (not shown) and circuits in a printed circuit board (PCB) 120, or in some other fashion. Connector 122 is retained by the shells 118, 116 and oriented towards an exterior of the fan tray assembly, as shown in FIG. 2. Connector 122 can be retained by mounting to the PCB 120 that is, in turn, retained by the shells 118, 116, via bottom corner snap element 145, slot 156, and partial slots 153 on the shell 116, as shown. In the alternative, PCB 120 may be replaced by a passive structural plate (for example, if no control circuit is needed in the fan tray assembly), or mounted to the fan tray assembly separate from a PCB or plate. The embodiment shown in FIG. 2 has the advantage of retaining the connector and a control circuit using the same mounting system, which is described in more detail below.

Interlocking attachment and retention features (or couplings or coupling elements) are preferably provided in areas near opposite sides 40*a* and 40*b* of the shell 116, as shown in FIGS. 1 to 8. The interlocking attachment and retention features of the shell 116 are configured to engage complementary interlocking attachment and retention features of the shell 118. The interlocking attachment and retention features of the shell 118 include a top center snap element 170 incorporated with a snap slot 174, a hook eyelet 175 near a first end 150 of shell 118, and an attaching tab 68 on a second end 148 of shell 118. The interlocking attachment and retention features of 116 include bottom center snap element 140 incorporated with a snap tab 182 and bottom corner snap element 145 incorporated with a hook 185.

Figure 3:
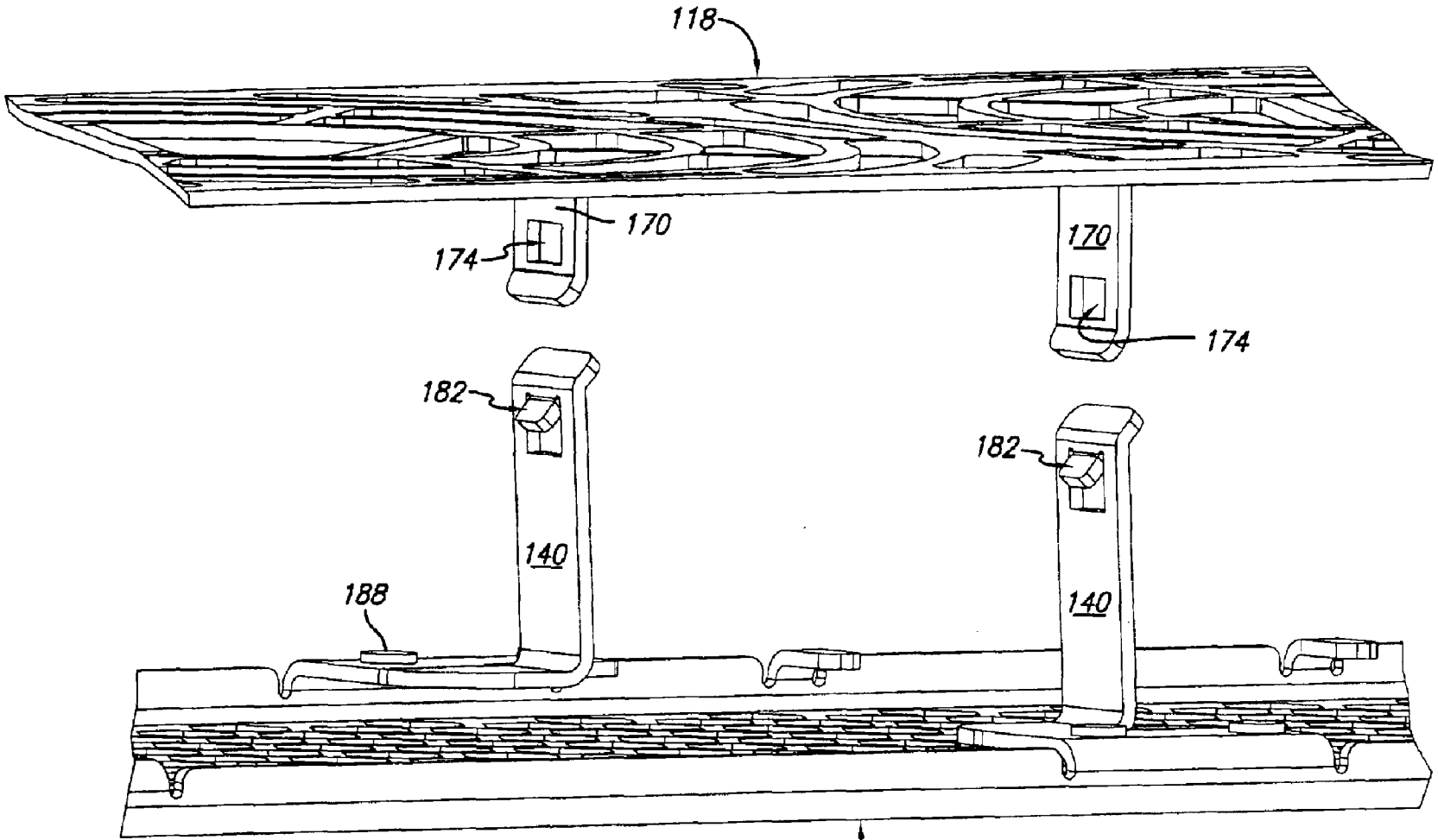
FIG. 3 is an exploded assembly view of an exemplary coupling feature for an exemplary fan tray assembly.
Figure 6:
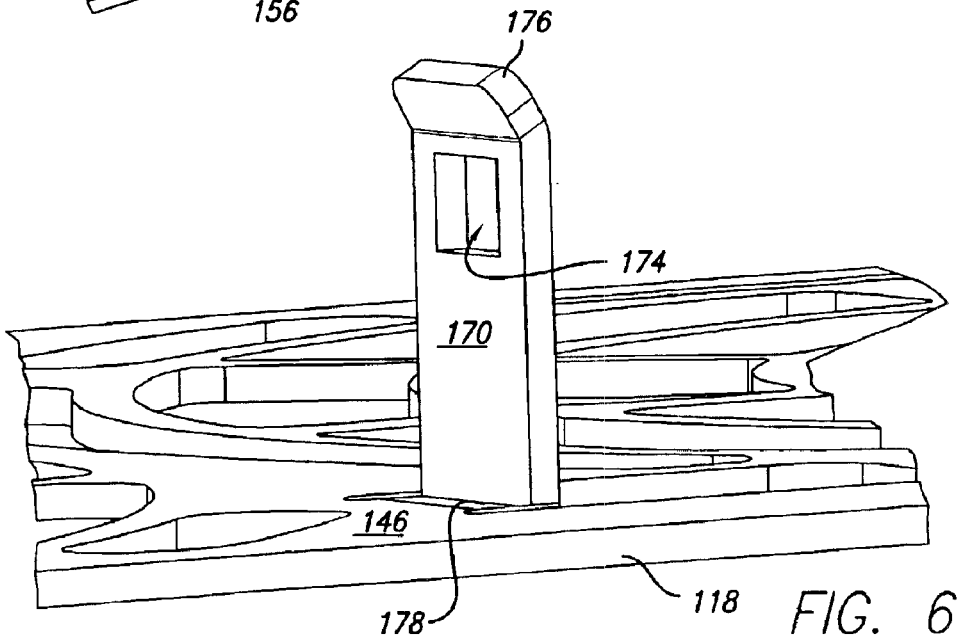
FIG. 6 is a perspective view of a snap element shown in FIG. 3.

FIGS. 3 and 6 illustrate an embodiment of the top center snap element 170 in more detail. The top center snap element 170 is coupled to the shell 118 on a bottom face 146 of the shell 118. The top center snap element 170 extends outward from the bottom side of 146. The top center snap element 170 can be contiguous with shell 118 and made from the same material as the shell 118. The top center snap element 170 includes a snap tab slot 174 formed in the top center snap element 170. The snap tab slot 174 is attachable with the corresponding bottom center snap tab 182 of the bottom shell 116. The top center snap element 170 also includes a transition section 176 at an end distal from the shell 118. The transition section 176 can be an angled region of the top center snap element 170 that allows for the top center snap element 170 and corresponding bottom center snap element 140 to be coupled such that binding or interference of the two elements 170, 140 is minimized. Opposite the transition section 176 is a base section 178 of the shell 118. The base section 178 is located on the bottom face 146 of the shell 118. The base section 178 allows for flexure or biasing of the top center snap element 170, such that the top center snap element 170 can deflect aside and then return to a non-biased position when attaching with the corresponding bottom center snap element 140 when assembling the fan tray assembly 100. In one embodiment of the present invention, the deflection and then return to the non-biased position of the top center snap element 170 is accomplished using only standard sheet steel having no spring steel. In another embodiment, the top center snap element 170 is designed using statistical tolerance analysis to ensure a good quality fit with the bottom center snap element 140.

Figure 7:
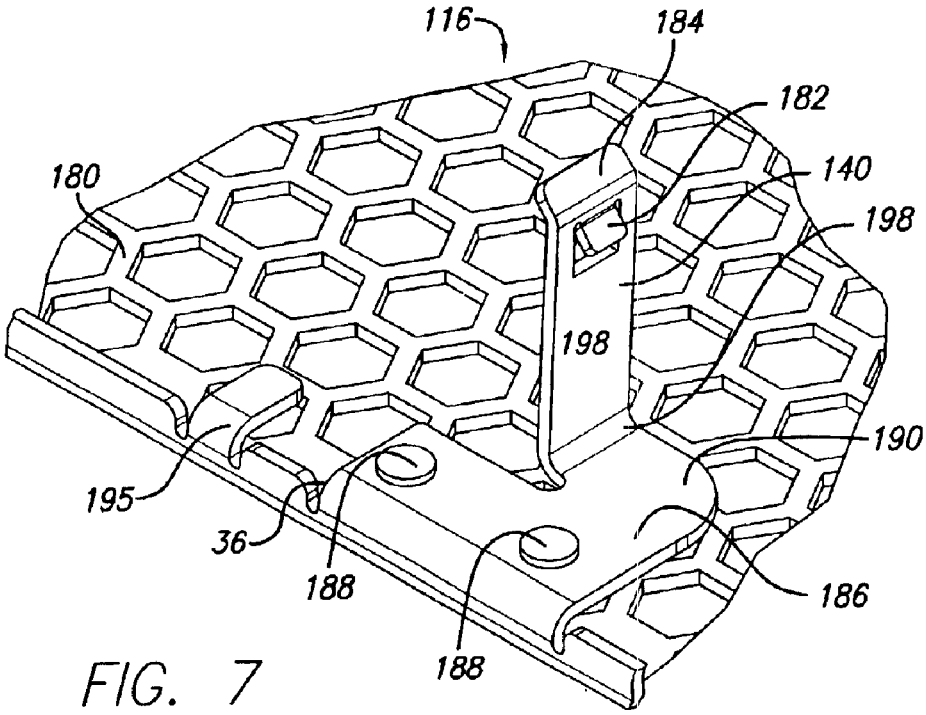
FIG. 7 is a perspective view of another snap element shown in FIG. 3.

Referring now to FIGS. 3 and 7, an exemplary bottom center snap element 140 is shown. The bottom center snap element 140 is coupled to a top face 180 of the shell 116 such that the bottom center snap element 140 extends outward from the top face 180. The bottom center snap element 140 can also be contiguous with the shell 116 and made from the same material as the shell 116. The bottom center snap element 140 includes a snap (or lock) tab 182 formed in the bottom center snap element 140. The snap tab 182 is attachable (or lockable) with a corresponding top center snap element 170 (e.g., the tab slot 174 of the top center snap element shown in FIG. 6). The bottom center snap element 140 also includes a transition section 184 at an end distal from the shell 116. The transition section 184 can be an angled region of the bottom center snap element 140 that allows for the bottom center snap element 140 and corresponding top center snap element 170 to be coupled such that binding or interference of the two elements 170, 140 is minimized. Opposite the transition section 184 is a base section 186 of the shell 116. The base section 186 has a flexure region 198 and a wire mount region 190. The base section 186 is located on the top face 180 of the shell 116. The flexure region 198 of the base section 186 allows for flexure or biasing of the bottom center snap element 140, such that the bottom center snap element 140 can deflect aside and then return to a non-biased position when attaching with the corresponding top center snap element 170 when assembling the fan tray assembly 100. In one embodiment of the present invention, the deflection and then return to the non-biased position of the flexure region 198 of the bottom center snap element 140 is accomplished using only standard sheet steel having no spring steel. In another embodiment, the bottom center snap element 140 is designed using statistical tolerance analysis to ensure a good quality fit with the bottom center snap element 170.

Referring still to FIG. 7, mounting dimples (or numbs) 188 are also shown to be disposed on the base section 186 or on a face of the wire mount region 190. The mounting dimples 188 are designed for securing the ventilation fans 112 without the use of separate fasteners. That is the mounting dimples 188 can fit into the through holes 126 of the ventilation fans 112 for coupling the fans 112 to the shell 116. A separate wire mount 195 is also shown to be located on the shell 116 and is used to secure the wiring(s) for the ventilation fans 112 and/or other devices of the fan tray assembly 100. Similarly, the wire mount region 190 of the base section 186 can also be used to secure the wiring(s) for the ventilation fans 112. Other wire mounts, such as wire mount 195 shown in FIG. 8, can also be located on the shell 116 to secure the wiring(s) of the ventilation fans 112 and/or other devices associated with the fan tray assembly 100.

Figure 4:
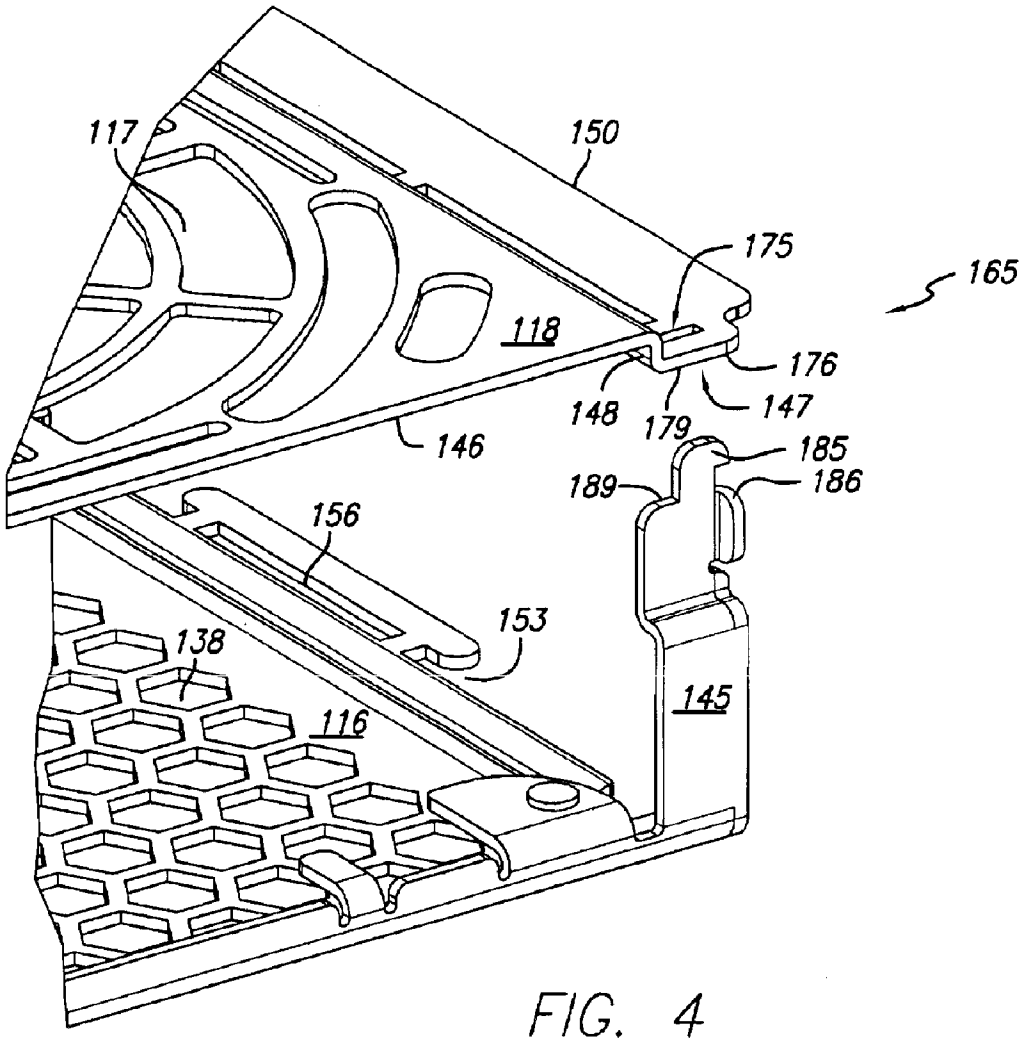
FIG. 4 is an exploded assembly view of another exemplary coupling feature for an exemplary fan tray assembly.
Figure 8:
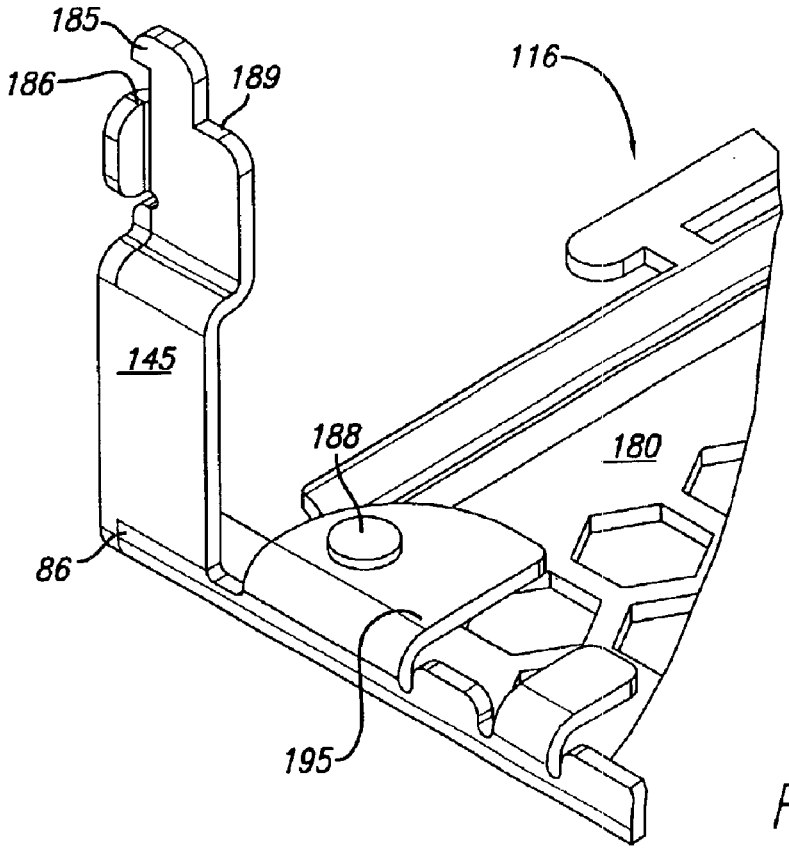
FIG. 8 is a perspective view of a snap element shown in FIGS. 4 and 5.

Referring to FIGS. 4–5 and 8, an exemplary embodiment of the bottom corner snap element 145 and the top corner snap element 165 are shown. The bottom corner snap element 145 is coupled to the shell 116 on a top face 180 of the shell 116 such that the bottom corner snap element 145 extends outward from the top face 180. The top corner snap element 165 is defined at around a corner of a first end 148 of shell 118. The bottom corner snap element 145 includes a hook 185, a stop block 186, and a bottom corner block 189. The top corner snap element 165 includes a hook eyelet 175 located on shell 118 and a top block 176 (or blocks 176 and 179) located on a bottom face 147 of shell 118: The bottom face 147 is slightly lower than a second and larger bottom face 146 of shell 118 (e.g., the bottom face 146 shown in FIGS. 2 and 6). The top block 176, 179 is partially defined by a vertical plane 148 that joins the first bottom face 147 with the second bottom face 146. The hook 185 of the bottom corner snap element 145 and bottom corner and stop blocks 186 and 189 of the bottom corner snap element 145 are all formed in the corner snap element 145. The hook 185 is attachable (or lockable) to the corresponding top hook eyelet 175. The bottom corner block 189 and the stop block 186 can be use to block corresponding top block 176 (or top corner block 179 and face block 176, respectively). Thus, the corner snap elements 145 and 165 uses the hook 185 and the hook eyelet 175, the face and stop blocks 176 and 186, and the top and bottom corner blocks 179, 189 to securely snap, attach, or lock the bottom corner snap element 145 with the top corner snap element 165.

Referring still to FIG. 8, the bottom corner snap element 145 also includes a base section 86. The base section 86 is proximate to the shell 116 on the top face 180. The base section 86 allows for flexure or biasing of the bottom corner snap element 145 so that the bottom corner snap element 145 can deflect aside and then return to a non-biased position when attaching with the top corner snap element 165. In one embodiment of the present invention, the deflection and then return to the non-biased position of the bottom corner snap element 145 is accomplished using only standard sheet steel having no spring steel. In another embodiment, the corner snap elements 175 and 165 are designed using statistical tolerance analysis to ensure a good quality fit with each other. A wire mount 195 is also shown to be located on the top face 180. The wire mount 195 secures wiring(s) for the fans 112 and/or other devices associated with the fan tray assembly 100. For example, a bottom face of the wire mount 195 can be used with the top face 180 to sandwich (or secure) the wiring(s) in place.

Figure 9:
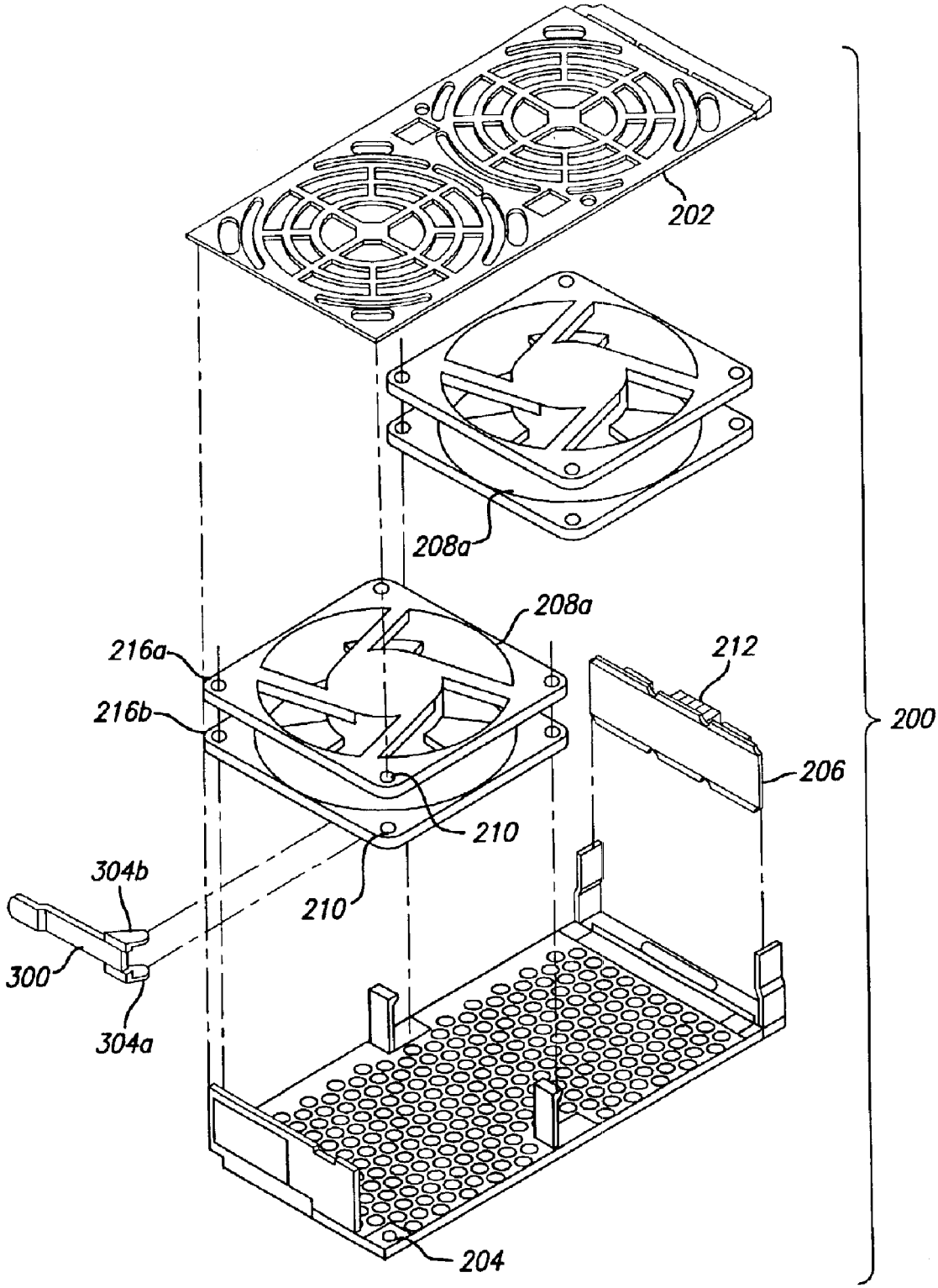
FIG. 9 is an exploded assembly view of another exemplary fan tray assembly.

The fan tray assembly of the present invention can further include a handle 300. Referring now to FIG. 9, fan tray 200 comprises outlet grill shell 202, inlet shell 204, handle 300, and, interposed between shells 202 and 204, ventilation fans 208*a*, 208*b* and circuit board 206. Ventilation fans 208*a*, 208*b* are connected by cables (not shown) to circuit board 206. Circuit board 206 is mounted at an end of fan tray 200 opposite to handle 300. The circuit board 206 includes an interface connector 212 that extends away from the end of the fan tray. The interface connector 212 is for engaging with a corresponding connector in an electronics enclosure (not shown).

Snap tabs 304*a*, 304*b* fit between flanges 216*a*, 216*b* of fan 208*a*, and each tabs 304*a*, 304*b* is inserted into one of the mounting holes 210. To assemble handle 300 between flanges 216*a*, 216*b*, the snap tabs 304*a*, 304*b* are compressed towards one another until the tabs 304*a*, 304*b* snap into place inside of holes 210. Thus, assembly of handle 300 to the fan tray may be accomplished without using any separate fastener such as a screw or rivet. In the alternative, handle 300 may be attached to components of fan tray 200 other than fan 208*a*. Yet another alternative is to provide holes as retention features in tabs 304*a*, 304*b*, which snap over dimples on a fan or other component of a fan tray.

Figure 10:
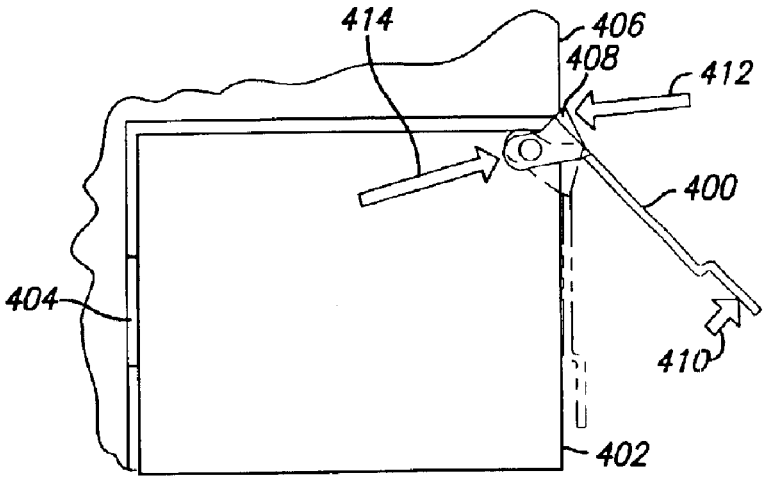
FIG. 10 is a side view of an exemplary fan tray assembly, showing operation of an exemplary handle for the exemplary fan tray assembly.
Figure 11:
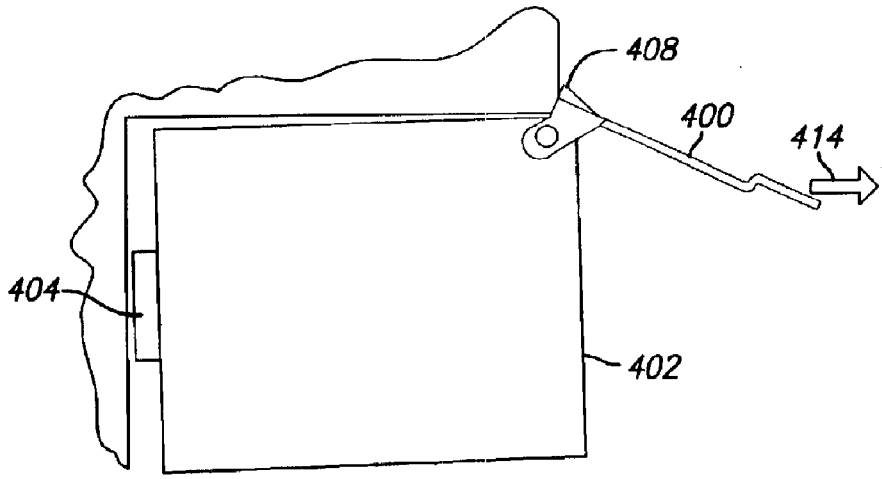
FIG. 11 is another side view showing operation of the exemplary handle for the exemplary fan tray assembly of FIG. 10 in a pull mode.

The handle of the fan tray assembly of the present invention can be used to assist a user to disengage the connector of the fan tray assembly from an electronic enclosure. Referring to FIGS. 10 and 11, a handle 400 of an exemplary fan tray assembly of the present invention is shown. Referring to FIG. 10, application of force 410 causes the bump edge 408 to exert an amplified force 412 on the electronic enclosure, generally in the direction of the force arrow 412. The pivot point is in turn determined by the location of the bushings in the tabs of the handle (e.g., as previously described referencing FIG. 9). In reaction to force 412, a disengagement force 414 is exerted on fan tray 402 at the pivot point of the handle, generally in the direction of arrow 414. With reference still to FIG. 10, a horizontal force acting on the fan tray towards the right will tend to disengage the connector 404. After connector 404 has disengaged from the electronic enclosure as shown in FIG. 11, handle 400 may be used as a pull handle. The user then applies a pulling force on the lever arm of the handle. An exemplary pulling force is indicated by the arrow 414 of FIG. 11. Removal of fan tray 400 will proceed in the direction of the arrow 414.

It should be apparent that fan tray assembly of the present invention reduces or eliminates any need to use separate fasteners, spring steels, or adhesives in its assembly. As used herein, a "separate fastener" is any piece of loose fastening hardware, such as a screw, bolt, rivet, clip, tie, and so forth. "Spring steels" include a spring steel sheet (e.g., not a standard structural steel sheet or not a standard sheet steel) and/or a steel sheet laminated with a spring steel sheet. "Adhesive" is used broadly to include solder, braze, and welded material, as well as resin-based adhesive material. For example, shells 116, 118 may be attached by the above described attachment features without the use of separate fasteners, spring steels, or adhesives. Likewise, the ventilation fans 112 may be retained between the shells without the use of separate fasteners or adhesives.

As used herein, the terms "top" and "bottom" when applied to the shells are used merely for convenience to indicate the relative positions of the shells as shown in FIGS. 1–5 and 7–8. It should be apparent that these terms do not in any way limit the orientation of the fan tray; for example, the fan tray may be oriented so that the "top" shell is underneath the "bottom" shell, and vice-versa. It should further be apparent that the features described herein as being on one of the shells may instead be provided on the other shell, so long as the complementary nature of the shells is preserved. For example, the snap tabs 182 on the bottom shell 116 may be provided on the bottom shell 118, so long as complementary slots 174 are provided for them on the bottom shell. Many such variations are possible within the general parameters of complementary interlocking shells in a fan tray assembly according to the invention.

A suitable shape for grills 117 and/or openings 138 are shown in plan view in FIGS. 1 and 2. Retention features (dimples) 188 are shown in FIG. 2 arranged around a periphery of shell 116. The dimples 188 can protrudes out of shells 116 and/or 118, and are positioned to correspond with mounting holes in a ventilation fan frame. A detail side view of an exemplary dimple 188 is shown in FIG. 12. In an embodiment of the invention, dimple 188 is a substantially hemispherical protrusion having a radius sufficiently small to engage the holes of the fan frame. A hemispherical shape has the advantage of being readily formed without overstressing the sheet material.

Other shapes may be used for the fan retention features. For example, a pyramidal protrusion may be pressed into the sheet material for engaging a round or square hole in a fan frame. Or, the sheet material may be cut and shaped to provide a tab configured to fit in a hole or slot in a fan frame, or around exterior parts of a fan frame. In the alternative, a hole or recess could be formed in a surface of shells 116, 118 for receiving a protruding feature of a fan frame. Whatever the configuration of the fan retention features, shells 116, 118 should be configured to compress the ventilation fan between their interior surfaces to prevent shifting or rattling of the fan during handling or operation. In an embodiment of the invention, this compression may be supplied mainly by snap elements 140, 170, 145, 165, as shown.

When attached by the attachment features (e.g., snap tabs 182 and slots 174) the interior distance between the opposing shells should be such that the snap elements 140, 170, 145, 165 and/or shells 116, 118 compress the ventilation fan enough to hold it firmly in position. At the same time, the outward pressure exerted by the ventilation fan on the interlocked shells may help keep the shells locked firmly in position.

This balancing of inward compression on the fan and outward pressure on the shells stabilizes the assembly. Too much compression will impede assembly of the fan tray and may damage components. Too little compression will result in an unstable, rattling fan tray. One of skilled in the art may select a suitable sheet material and geometry to achieve a proper amount of compression for a given application. Snap elements 140, 170, 145, 165 advantageously provide additional resiliency to the assembled shells with respect to the fan, thereby easing the degree of precision to which the shells need be made.

Referring now back to FIG. 2, an exemplary controller PCB 120 for use with fan tray 100 is shown. PCB 120 defines an x-y plane on which connector 122 is located. The x-y plane is also shown in plan view in FIG. 9. Connector 122 is for connecting the PCB to a parent assembly, and extends perpendicularly from the board 120 along a z-axis. Board 120 may be of a uniform thickness that is sufficiently less than the width of the mounting slots 156, 153 to permit sliding of the board relative to the slots.

PCB 120 may contain a control circuit and/or electrical traces connecting connector 122. In an alternative embodiment, PCB 120 may be replaced by a purely mechanical board or plate, for example, for connecting a ventilation fan directly to an external control circuit. It should be apparent that, in either case, a connector mounted on the board or plate may be retained in the fan tray by the shells 116, 118 without using a separate fastener or adhesive.

Having thus described a preferred embodiment of a fan tray for an electronic enclosure, it should be apparent to those skilled in the art that certain advantages of the within system have been achieved. It should also be appreciated that various modifications, adaptations, and alternative embodiments thereof may be made within the scope and spirit of the present invention. For example, a fan tray for two individual ventilation fans has been illustrated, but it should be apparent that the inventive concepts described above would be equally applicable to fan trays for a single fan or more than two fans. For further example, particular shapes of shells, tabs, dimples, slots, latches, grills, holes, and so forth, have been illustrated, but one of ordinary skill may devise other suitable shapes for such elements in conformance with the inventive concepts herein. The invention is further defined by the following claims.

What is claimed:

1. A fan tray assembly for an electronics enclosure, comprising:

a first shell made of a first sheet material, said first shell comprising a first air passage formed in said first shell and a plurality of first coupling elements formed in said first sheet material around a periphery of said first shell, said plurality of said first coupling elements comprising a first snap element having an eyelet formed in said first sheet material around a corner of said first shell, said plurality of said second coupling elements comprising a second snap element having a hook for attaching to said eyelet;

a second shell spaced apart from said first shell and made of a second sheet material, said second shell opposing said first shell and comprising a second air passage formed in said second shell and a plurality of second coupling elements coupled with said first coupling elements and formed in said second sheet material around a periphery of said second shell;

a ventilation unit retained between said first and second shells by said first and second coupling elements and substantially aligned with said first air passage; and an electronic connector connected with said ventilation unit and retained by said first and second shells, said electronic connector orienting towards an exterior of the fan tray assembly.

2. The fan tray assembly of claim 1, wherein the fan tray assembly includes no separate fastener and no adhesive for attaching said first and second shells together.

3. The fan tray assembly of claim 2, wherein the fan tray assembly includes no spring steel for attaching said first and second shells together.

4. The fan tray assembly of claim 2, wherein the fan tray assembly uses only said first and second sheet materials for attaching said first and second shells together.

5. The fan tray assembly of claim 4, wherein said first and said second sheet materials comprise a standard sheet steel having no spring steel.

6. The fan tray assembly of claim 2, wherein the fan tray assembly includes no separate fastener and no adhesive for retaining said ventilation unit to the fan tray assembly.

7. The fan tray assembly of claim 2, wherein the fan tray assembly includes no separate fastener and no adhesive for retaining said electrical connector.

8. The fan tray assembly of claim 1, wherein said first air passage comprises two air grills, wherein said ventilation unit comprises two ventilation fans aligned with said two air grills of said first shell.

9. The fan tray assembly of claim 1, wherein said second snap element comprises a transition section for minimizing an interference between said first and second snap elements.

10. The fan tray assembly of claim 9, wherein said transition section is an angled region of said second snap element.

11. The fan tray assembly of claim 1, wherein said second snap element is aligned with said eyelet of said first snap element and formed in said second sheet material around a corner of said second shell.

12. The fan tray assembly of claim 11, wherein said second snap element can deflect aside and then return to a non-biased position when attaching to said first snap element and wherein said second snap element comprises a standard sheet steel having no spring steel.

13. The fan tray assembly of claim 1, wherein said first snap element further comprises a first block located on a first face of said first shell and around a region of said first shell surrounding said eyelet and wherein said first face is offset from a second and larger face of said first shell.

14. The fan tray assembly of claim 13, wherein said second snap element further comprises second and third blocks corresponding with said first block and wherein said second and third blocks are formed in said second sheet material and designed to block said first block when said hook of said second snap element is attached to said eyelet of said first snap element.

15. The fan tray assembly of claim 1, further comprising a handle designed to assist with removal of the fan tray assembly from an enclosure and retained between said first and second shells and wherein said handle is retained between said first and second shells with no separate fastener and no adhesive.

16. The fan tray assembly of claim 1, wherein said plurality of said first and second coupling elements comprise a plurality of dimples configured to fit at least partially inside of a corresponding hole in a frame of said ventilation unit.

17. The fan tray assembly of claim 1, further comprising a printed circuit board defining an x-y plane of the fan tray assembly and wherein said electrical connector is mounted to said printed circuit board with said electrical connector extending along a z-axis perpendicular to said x-y plane.

18. The fan tray assembly of claim 1, wherein said plurality of said first and second coupling elements are designed using statistical tolerance analysis to ensure a quality fit when said plurality of said first coupling elements are coupled to said plurality of said second coupling elements, wherein the fan tray assembly uses only said first and second sheet materials for attaching said first and second shells together, and wherein said first and second sheet materials comprise a standard sheet steel having no spring steel.

19. A fan tray assembly for an electronics enclosure, comprising:

a first shell made of a first sheet material, said first shell comprising a first air passage formed in said first shell and a plurality of first coupling elements formed in said first sheet material around a periphery of said first shell;

a second shell spaced apart from said first shell and made of a second sheet material, said second shell opposing said first shell and comprising a second air passage formed in said second shell and a plurality of second coupling elements coupled with said first coupling elements and formed in said second sheet material around a periphery of said second shell, said plurality of first coupling elements comprising a first snap element, said second plurality of coupling elements comprising a second snap element, wherein each of the first and second snap elements can deflect aside and then return to a non-biased position when they are attached to one another;

a ventilation unit retained between said first and second shells by said first and second coupling elements and substantially aligned with said first air passage; and an electronic connector connected with said ventilation unit and retained by said first and second shells, said electronic connector orienting towards an exterior of the fan tray assembly.

20. The fan tray assembly of claim 19, further comprising means for retaining said electronic connector without using a separate fastener, without using a spring steel, and without using an adhesive.

21. The fan tray assembly of claim 19, further comprising a handle designed to assist with removal of the fan tray assembly from an enclosure and retained between said first and second shells.

22. The fan tray assembly of claim 21, further comprising means for retaining said handle between said first and second shells without using a separate fastener, without using a spring steel, and without using an adhesive.

23. The fan tray assembly of claim 19, wherein said first snap element comprises a slot and wherein said second snap element comprises a snap tab for snapping into said slot.

24. The fan tray assembly of claim 19, wherein said first air passage comprises two air grills and wherein said first snap element is formed in said first sheet material around said periphery of said first shell and between said two air grills.

25. The fan tray assembly of claim 24, wherein said ventilation unit comprises two ventilation fans aligned with said two air grills of said first shell.

26. The fan tray assembly of claim 19, wherein said ventilation unit comprises two ventilation fans and wherein said second snap element is formed in said second sheet material around said periphery of said first shell and between said two ventilation fans when said two ventilation fans are retained by said first and second shells.

27. The fan tray assembly of claim 19, wherein each of said first and second snap elements comprises a transition section for minimizing an interference between said first and second snap elements.

28. The fan tray assembly of claim 27, wherein said transition section is an angled region of each of said first and second snap elements.

29. The fan tray assembly of claim 19, wherein said first and second snap elements are formed using only standard sheet steels without spring steels.

* * * * *